US007001148B2

(12) United States Patent
Cardenas et al.

(10) Patent No.: US 7,001,148 B2
(45) Date of Patent: Feb. 21, 2006

(54) REPLACEABLE INSERT FOR CENTRIFUGAL BLOWER FLOW CONTROL

(75) Inventors: Alfredo Cardenas, Hermosa Beach, CA (US); Wilfred G. McKelvey, Rancho Palos Verdes, CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/738,605

(22) Filed: Dec. 16, 2003

(65) Prior Publication Data

US 2004/0228725 A1 Nov. 18, 2004

Related U.S. Application Data

(60) Provisional application No. 60/435,325, filed on Dec. 19, 2002.

(51) Int. Cl.
*F04D 29/44* (2006.01)

(52) U.S. Cl. ..... 415/196; 415/197; 415/206; 415/214.1

(58) Field of Classification Search ..... 415/170.1, 415/172.1, 196, 197, 203, 204, 206, 212.1, 415/214.1
See application file for complete search history.

(56) References Cited

U.S. PATENT DOCUMENTS

| | | | | |
|---|---|---|---|---|
| 1,465,097 A | | 8/1923 | Sherzer | |
| 3,316,848 A | * | 5/1967 | Egger | 415/204 |
| 3,664,001 A | | 5/1972 | Pilarczyk | |
| 4,676,717 A | | 6/1987 | Willyard, Jr. et al. | |
| 4,691,423 A | | 9/1987 | Willyard, Jr. et al. | |
| 4,913,619 A | * | 4/1990 | Haentjens et al. | 415/172.1 |
| 5,207,565 A | | 5/1993 | Roessler | |
| 6,193,463 B1 | | 2/2001 | Adeff et al. | |

FOREIGN PATENT DOCUMENTS

| | | |
|---|---|---|
| DE | 301 114 C | 11/1954 |
| FR | 2 434 939 A | 3/1980 |
| GB | 2 300 883 A | 11/1996 |

OTHER PUBLICATIONS

International Search Report Oct. 29, 2004.

* cited by examiner

*Primary Examiner*—Edward K. Look
*Assistant Examiner*—Dwayne J White

(74) *Attorney, Agent, or Firm*—Oral Caglar, Esq.

(57) ABSTRACT

The present invention provides a method and apparatus for varying the high flow and low pressure operating range of a centrifugal blower. Centrifugal blowers are designed and rated for a certain capacity at a certain speed. The present invention provides an apparatus for varying, regulating, or adjusting an inlet capacity of a centrifugal blower. Without the need to redesign or change any blower components, the blower operating range may be changed without affecting blower efficiency. No aerodynamic performance is lost at low flow conditions.

31 Claims, 6 Drawing Sheets

REPLACEABLE INSERT FOR CENTRIFUGAL BLOWER FLOW CONTROL

CROSS-REFERENCE TO RELATED APPLICATIONS

This application claims the benefit of U.S. Provisional Patent Application No. 60/435,325, filed on Dec. 19, 2002.

BACKGROUND OF THE INVENTION

The present invention relates generally to a compressor housing modification for the compressor portion of an internal combustion engine or other compressor apparatus and, more specifically, to a method and apparatus for varying the high flow and low pressure operating range of a centrifugal blower.

Turbines may use the exhaust gasses discharged from internal combustion engines as a motive gas to rotate a turbine wheel that may be mounted on one end of a shaft. A compressor impeller may be mounted on the other end of the shaft, and is turned by the turbine wheel to compress gas, which then may be communicated to the engine, thereby supplying charge gas to the engine for increasing engine performance. To improve operating efficiency and to extend range, it may be desirable to control the flow of motive exhaust gasses into the compressor impeller.

Aircraft, spacecraft, military vehicles, and other vehicles depend upon auxiliary systems, such as pneumatic equipment for pressurizing tanks, transferring fuel (e.g., refueling operations), generating vacuum (e.g., sanitation systems), and other processes. The auxiliary systems consume onboard power. To ensure efficient consumption of power, compressor air flow must be controlled.

Several attempts have been made to adequately control the flow of gases into a compressor. However, none have successfully used a nozzle to reduce airflow and power without reducing the maximum operating pressure of a blower. One such attempt is disclosed in U.S. Pat. No. 4,676,717 to Willyard, et al. A portion of a compressor housing that corresponds to the cross-sectional shape of a compressor wheel is called a throat. A throat insert is described. The prior art throat insert is shown in FIG. 1. A throat insert 105 is in the form of an annular orifice that reduces in radius as its surface moves away from its annular base 106 and toward a mounting collar 108. On the annular base 106 exists a protruding annular lip 107. An inner wall 109 includes a curved wall portion 109A and a straight wall portion 109B. In the cross-sectional view in FIG. 1, the shape of the throat insert 105 is flared, resembling a trumpet bell. An inner radius C of the throat insert 105 is substantially constant within the straight wall portion 109B. However, an inner radius E of the curved wall portion 109A gradually increases along the inner wall 109 in the direction away from straight wall portion 109B.

Referring now to a compressor housing 90 in FIG. 2, the throat insert 105 is inserted into an inlet 89 of the compressor housing 90. Annular lip 107 mates with the integrally formed seat 104. Air enters the inlet 89, is compressed by the rotation of a compressor wheel 87 and is conveyed into an encircling fluid conduit 102 and centrifugally accelerated out of the compressor housing 90 through a compressor outlet 91. The inner radius E, of curved wall portion 109A, increases until it is equal in length to a blade radius D of the compressor wheel 87.

Using a throat insert 105, that is flared, with an inner radius equal to the compressor wheel 87 blade radius D results in a design in which the compressor wheel 87 aerodynamic performance cannot be changed to accommodate varying power requirements. Consequently, the compressor wheel 87 power does not decrease with lower performance. This results in lower overall compressor efficiency.

Alternate designs, such a using a square-edge orifice plate instead of a nozzle on the compressor wheel inlet, as in U.S. Pat. No. 1,465,097 to Sherzer, change compressor performance by adding resistance. Thus, compressor power does not decrease with lower performance, resulting in lower compressor efficiency.

As can be seen, there is a need for an improved apparatus and method for controlling compressor volumetric flow, such that the flow and power may be reduced without reducing maximum operating pressure at low to zero flows

SUMMARY OF THE INVENTION

In one aspect of the present invention, an apparatus for compressing gas comprises a compressor impeller on a shaft; an impeller inlet tip blade radius; and a replaceable insert; the shaft and replaceable insert situated within a bore in a compressor housing; the replaceable insert situated in closely spaced-apart relation to the compressor impeller; the replaceable insert having a square edged outlet.

In an alternative aspect of the present invention, an apparatus for compressing gas comprises a compressor impeller on a shaft; and a replaceable insert concentrically disposed in relation to the shaft and centrally disposed in relation to the compressor impeller; the shaft and replaceable insert within a bore in a compressor housing, the replaceable insert having a cylindrical shape with a square edged outlet that is smaller in radius than an impeller inlet tip blade radius and the replaceable insert length is at least 0.25 times the impeller inlet tip blade radius.

In another aspect of the present invention, an apparatus for compressing gas comprises a compressor impeller on a shaft; an insert concentrically disposed in relation to the shaft and centrally disposed in relation to the compressor impeller; the shaft and insert within a bore in a compressor housing; and a volute fluid conduit in fluid communication with the flow restricting insert; the insert situated in closely spaced-apart relation to the compressor impeller; the insert having a cylindrical shape with a square edged outlet and an enlarged annular base with a radially outwardly protruding annular lip.

In yet another aspect of the present invention, a die cast compressor housing comprises a compressor impeller on a shaft; a replaceable insert concentrically disposed in relation to the shaft and centrally disposed in relation to the compressor impeller; the shaft and replaceable insert within a bore in a compressor housing; and a volute fluid conduit in fluid communication with the flow restricting insert; the replaceable insert situated in closely spaced-apart relation to the compressor impeller; the replaceable insert having a cylindrical shape with a square edged outlet that is smaller in radius than an impeller inlet tip blade radius and the replaceable insert length is at least 0.25 times the impeller inlet tip blade radius; the replaceable insert made from a corrosion resistant material; the replaceable insert having an enlarged annular base with a radially outwardly protruding annular lip; the radially outwardly protruding annular lip mating with an integrally formed seat within the bore; the replaceable insert secured within the bore by an interference fit; wherein the replaceable inlet insert has constant radius.

In a further aspect of the present invention, a method of remanufacturing a turbine housing comprises removing a first insert from a bore within a compressor housing; inserting a separate insert comprising a radially inwardly spaced annular collar portion and a square edged outlet; positioning the insert telescopically in the bore with the annular collar portion nested with and spaced radially outwardly from, a seat on an interior sidewall of the compressor housing; and securing the insert to the compressor housing in mating cooperation with the seat on an interior sidewall of the compressor housing.

In yet a further aspect of the present invention, a method of compressing gas comprises introducing a gas into an insert with a square edge outlet; accelerating centrifugally the gas with an impeller; and introducing the gas into a volute fluid conduit; wherein the volute fluid conduit is in fluid communication with the insert.

These and other aspects, objects, features and advantages of the present invention, are specifically set forth in, or will become apparent from, the following detailed description of a preferred embodiment of the invention when read in conjunction with the accompanying drawings.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The invention is useful for aircraft, spacecraft, military vehicles, and other vehicles. Specifically, the invention is useful for auxiliary systems, such as pneumatic equipment for pressurizing tanks, transferring fuel (e.g., refueling operations), generating vacuum (e.g., sanitation systems), and other processes. The invention is also useful for turbochargers. For illustrative purposes, the following description is of a compressor housing, however, it is to be understood that other applications can be substituted for the compressor housing.

Centrifugal blowers are designed and rated for a certain capacity at a certain speed. The present invention provides an apparatus for varying, regulating, or adjusting an inlet capacity of a centrifugal blower. Without the need to redesign or change any blower components, the blower operating range may be changed. An insert may be inserted into a compressor housing. An insert may be used to change the aerodynamic performance of the centrifugal blower without reducing the blower efficiency. No aerodynamic performance is lost at low flow conditions. The insert may have a square edged outlet that is smaller in radius than an impeller inlet tip blade radius. Also, the insert may have an axial length that is at least 0.25 times the impeller inlet tip blade radius. With these features, centrifugal blower air flow and power may be reduced without reducing the maximum operating pressure of the centrifugal blower.

Figure 1:
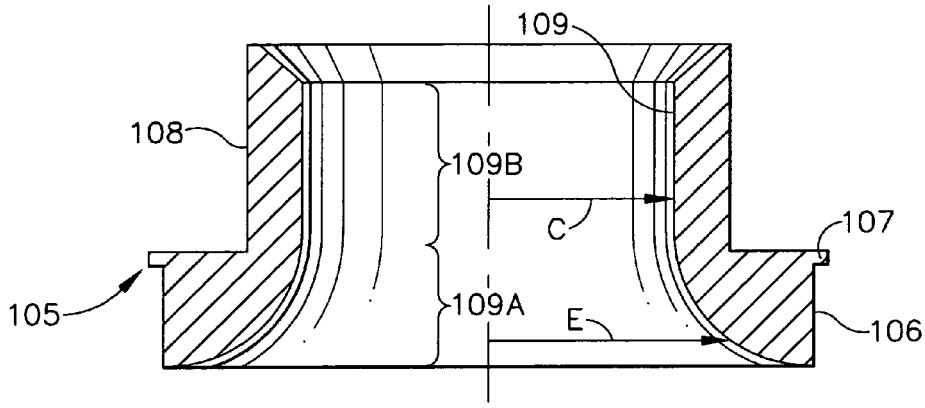
FIG. 1 (PRIOR ART)
FIG. 1 is a cross-sectional view of a prior art throat insert.
Figure 2:
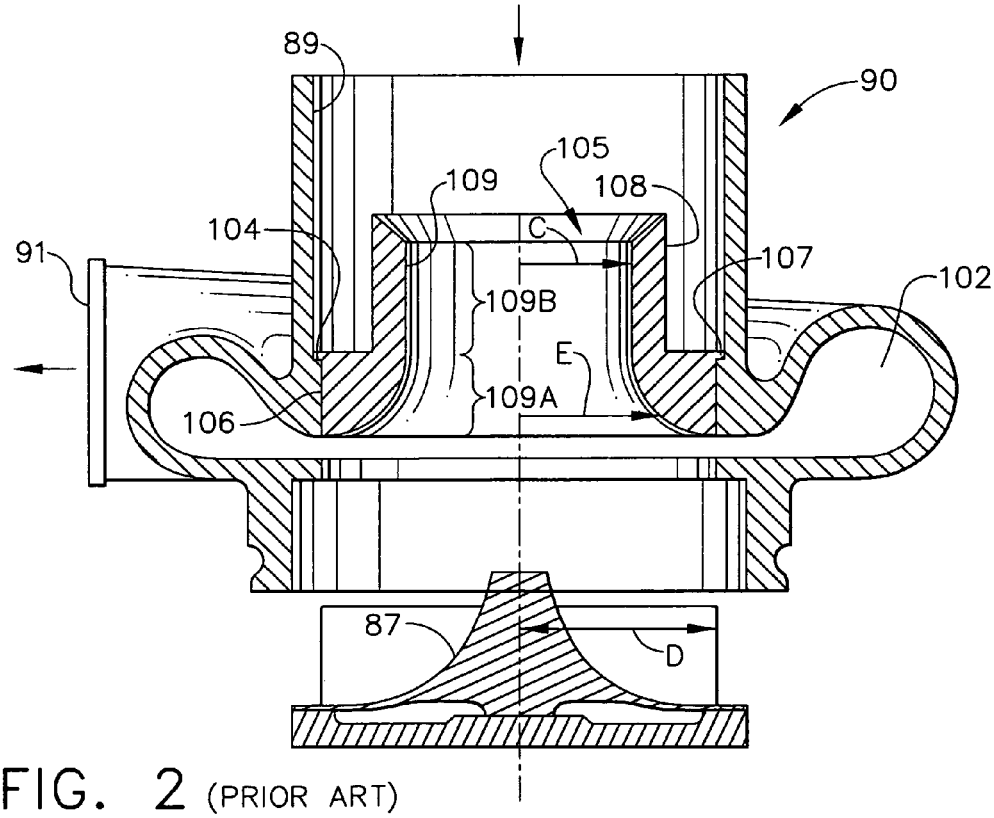
FIG. 2 (PRIOR ART)
FIG. 2 is a cross-sectional view of a prior art compressor housing with the prior art throat insert of FIG. 1 in position within the housing.
Figure 3:
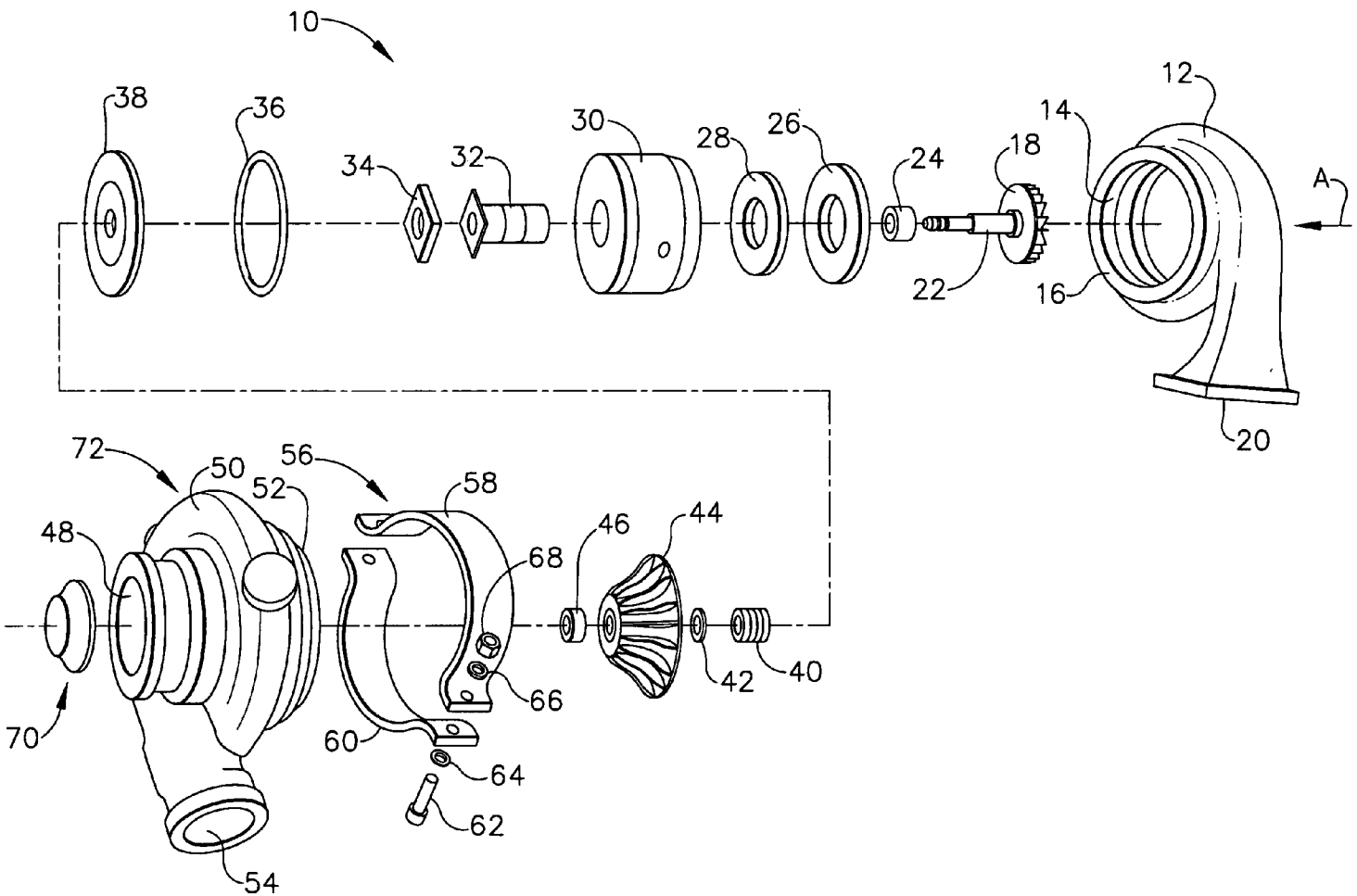
FIG. 3 is an exploded view of a turbine, according to an embodiment of the present invention.

In more specifically describing the present invention, and as can be appreciated from FIG. 3, the present invention provides a turbine 10. Exhaust gases A from an engine (not shown) may enter the turbine 10 through a turbine inlet 14 and impinge upon a concentrically mounted turbine wheel 18. The exhaust gases may exit an exhaust housing 12 centrifugally through an exhaust outlet 20. The turbine wheel 18 may be mounted on one end of a shaft 22. An oil seal 24, a heat shield 26, and an insulation ring 28 may be mounted on the shaft 22 adjacent to the turbine wheel 18. The shaft 22 may then be mounted concentrically within a bearing housing 30. The shaft 22 may rotate within a bearing 32 and a bearing insert 34. An O-ring 36 and an oil seal plate 38 may likewise be mounted on the shaft 22. An oil seal sleeve 40 and an oil control ring 42 may be mounted on the shaft 22 adjacent to the oil seal plate 38. The impeller 44 may be mounted on the shaft 22 and secured thereto by a rotor nut 46. The impeller 44 may be mounted within a bore 48 in a compressor housing 72, which may have a volute fluid conduit 50.

The exhaust housing 12 and the compressor housing 72 may be secured together by a V band clamp 56 formed from two semi-circular clamp members 58, 60, which may be secured together by a bolt 62 with washers 64 and 66, and a nut 68. The V band clamp 56 may engage an integrally formed, turbine annular flange 16 on the exhaust housing 12 and an integrally formed, compressor annular flange 52 on the compressor housing 72, holding the entire turbine 10 together.

An inlet insert 70 may be positioned within the compressor housing 72. Air at atmospheric pressure may enter the bore 48 and be compressed to a predetermined high pressure by the rotation of the impeller 44. The pressurized air may exit the compressor housing 72 centrifugally through a compressor outlet 54 which may be connected to an air intake manifold of an engine (not shown).

Figure 4A:
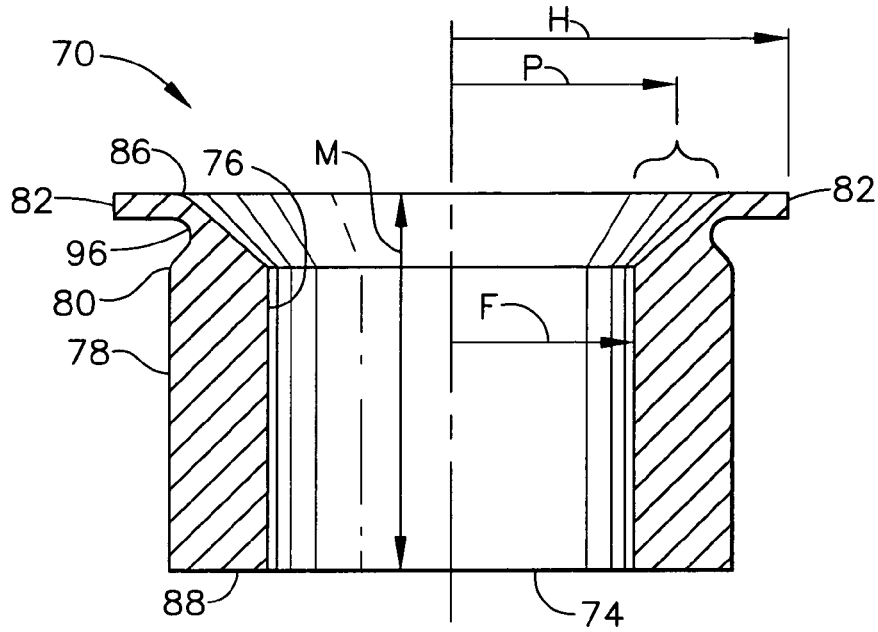
FIG. 4A is a cross-sectional view of an insert, according to an embodiment of the present invention.
Figure 4B:
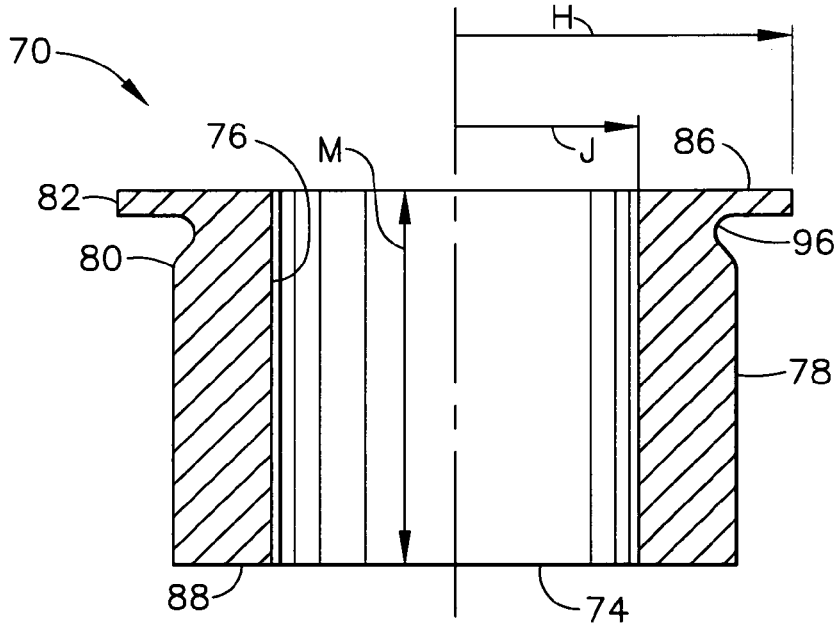
FIG. 4B is a cross-sectional view of an insert, according to an alternate embodiment of the present invention.

The insert 70 is shown in detail in FIG. 4A. The insert 70 may have a cylindrical shape with an inner surface 76 and an outer surface 78 with an outer radius H. The insert 70 may be made from a corrosion resistant material, such as cast aluminum or any other suitable material. The insert 70 may have the square edged outlet 74, with an inner radius F. The insert 70 may also have a radially outwardly protruding annular lip 82. The insert inlet may have a tapered inlet with a varying inner radius P, for example, as shown in FIG. 4A. Optionally the insert 70 may have an inner radius J that is constant, as shown in FIG. 4B. The insert 70 may have a flared shape at the inlet end 86, for example as shown in FIG. 4A. Optionally the insert 70 may have a square inlet end 86 as shown in FIG. 4B.

Figure 5B:
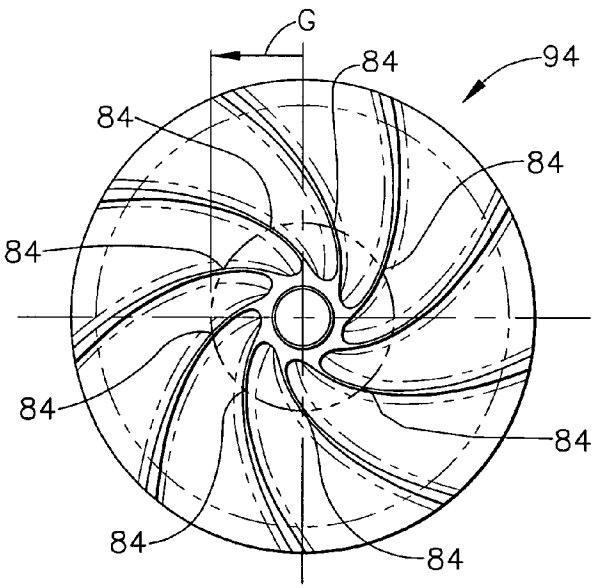
FIG. 5B is a top view of the compressor impeller of FIG. 5A.
Figure 5C:
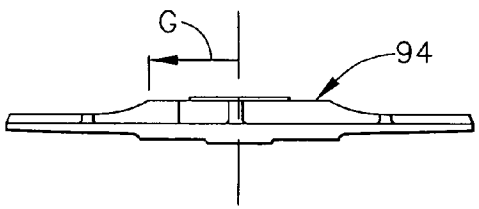
FIG. 5C is a side view of the compressor impeller of FIG. 5A.
Figure 5A:
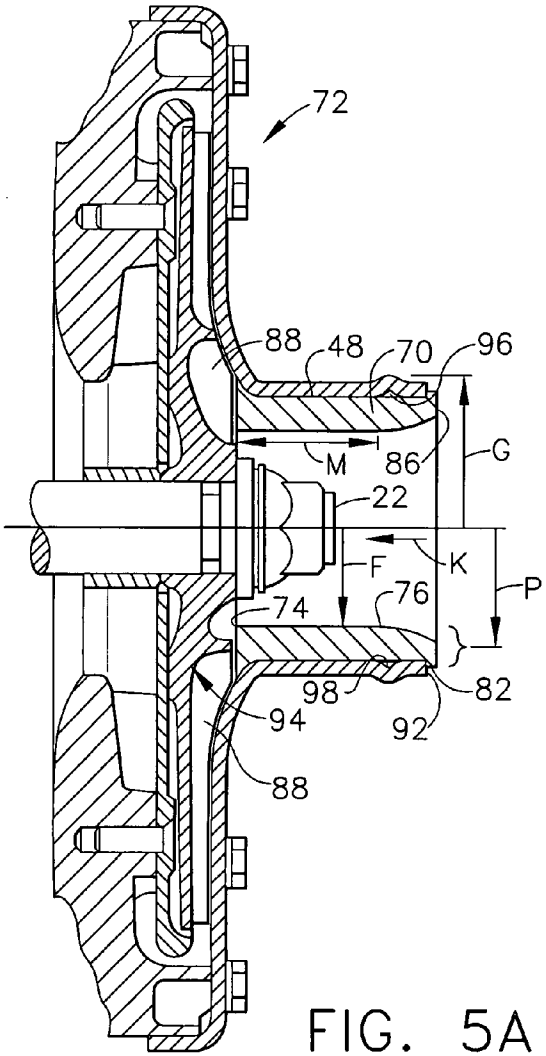
FIG. 5A is a cross-sectional view of a compressor housing with the insert of FIG. 4A in position within the housing.

Referring now to FIG. 5A, the insert 70 may be inserted telescopically into the bore 48 within the compressor housing 72. The insert 70 may have a tapered inlet end 86 with a varying inner radius P, such that insert 70 has an inner radius F that is smaller at an outlet end 88 than the inner radius P at an inlet end 86. Alternatively, the insert 70 may have a constant radius J (as in FIG. 4B). The compressor housing 72 may be made from any material suitable for compression conditions, such as die cast aluminum. The annular lip 82 may mate with an integrally-formed seat 92 for placement and alignment of the inset 70 within the compressor housing 72. The insert 70 may be secured within the bore 48 by an interference fit. The inserted insert 70 may be concentrically disposed in relation to the shaft 22 and centrally disposed in relation to a compressor impeller 94, which may rotate on the shaft 22. The inserted insert 70 may also be in closely spaced-apart relation to the compressor impeller 94. The insert 70 is in closely spaced-apart relation to the compressor impeller 94 when the insert 70 is situated as close as feasibly possibly to the compressor impeller 94, without the insert 70 contacting the compressor impeller 94.

A fluid K, perhaps a gas, such as air, may enter through the insert 70, and travel through the inner surface 76 of the insert 70. Upon the fluid K reaching the square edged outlet 74, the fluid K may be centrifugally accelerated by the compressor impeller 94. Referring to FIG. 5B, the impeller blades 84 may be seen to have an impeller inlet tip blade 84 radius G. The insert 70 may have the square edged outlet 74 that is smaller in radius F than the impeller inlet tip blade 84 radius G. Additionally, the insert 70 may have a length M that is at least 0.25 times the impeller inlet tip blade radius G, such that:

$M \leqq 0.25G$

Figure 6:
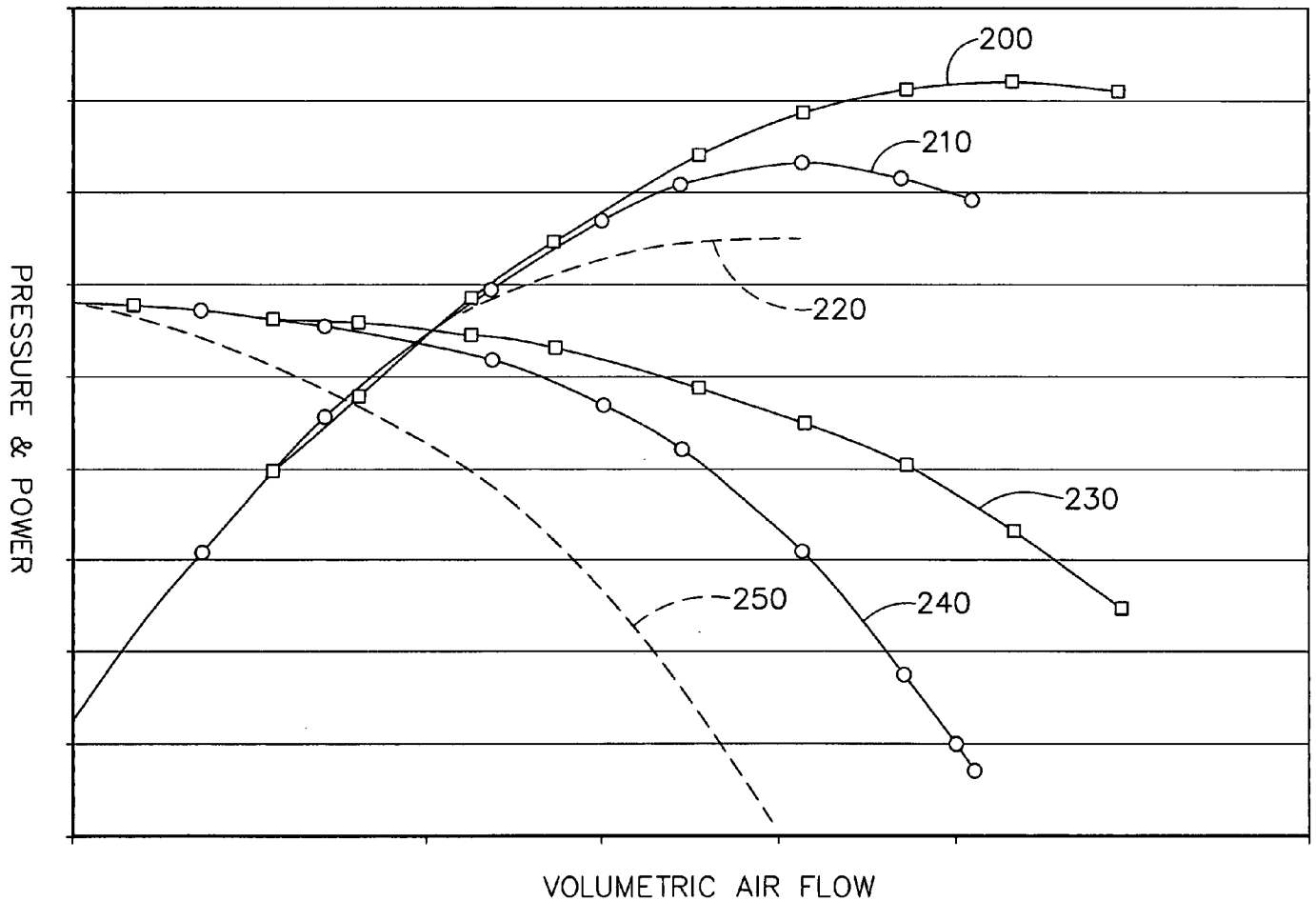
FIG. 6 is a graph illustrating pressure and power behavior, of a compressor housing, as a function of volumetric airflow.

The benefits of the square edged outlet 74, that is smaller in radius F than the impeller inlet tip blade radius G, may be demonstrated in FIG. 6. Likewise, having the length M that is at least 0.25 times the impeller inlet tip blade radius G may also be understood by referring to FIG. 6.

FIG. 6 is a graph of pressure and power as functions of volumetric airflow within the compressor housing 72 (FIG. 5A). A plot 230 represents the conventional pressure performance when using an insert 70 that has an inner radius that is equal to the impeller inlet tip blade radius G. A plot 200 represents the conventional power requirement of the a plot 230 pressure performance when using an insert that has an inner radius that is equal to the impeller inlet tip blade radius G. A plot 240 represents the lower pressure performance, at high flows, when using an insert 70 that has an inner radius J that is smaller than the impeller inlet tip blade radius G, according to an embodiment of the present invention. A plot 210 represents the lower power requirement of the a plot 240 pressure performance when using an insert that has an inner radius J that is smaller than the impeller inlet tip blade radius G, according to an embodiment of the present invention. A plot 250 represents the even lower pressure performance, at high flows, when using an insert 70 that has an inner radius J that is smaller than the impeller inlet tip blade radius G, according to an embodiment of the present invention. A plot 220 represents the even lower power requirement of the a plot 250 when using an insert that has an inner radius that is smaller than the impeller inlet tip blade radius according to an embodiment of the present invention. As can be seen in FIG. 6, the conditions of the plot 240 produce lower sufficient volumetric airflow with a lower power requirement, thus compressor efficiency does not change; while the conditions of the plot 250 produce even lower sufficient volumetric airflow with an even lower power requirement without affecting compressor efficiency.

Figure 7:
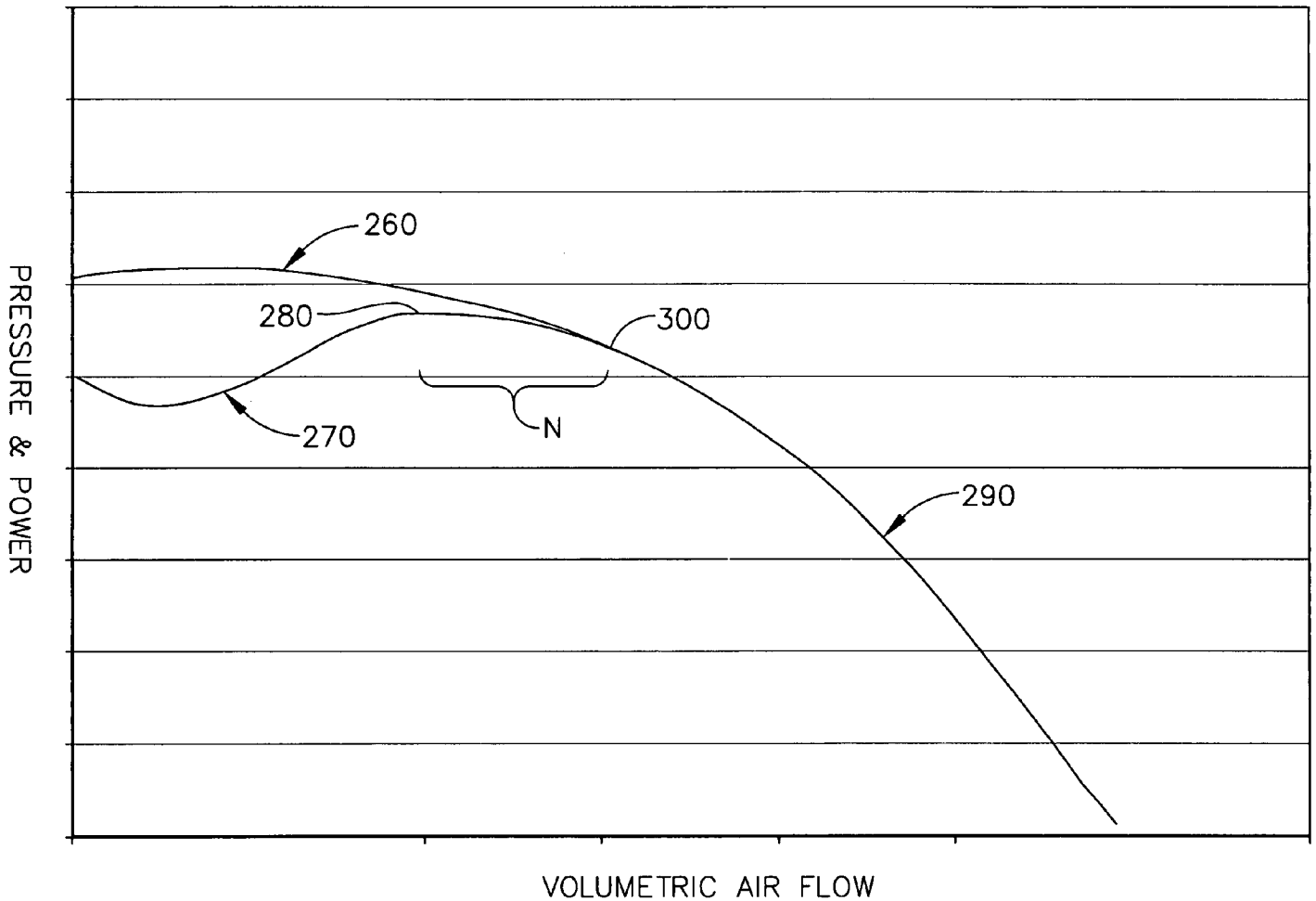
FIG. 7 is another graph illustrating pressure and power behavior, of a compressor housing, as a function of volumetric airflow.

Generally, without an insert 70, flow reduction at high flows also affects pressure at low flows. Compressor behavior, for example, pressure, under stall conditions may be seen in FIG. 7. At high volumetric air flows, for example, at a point 290, the compressor may operate normally. If volumetric air flow decreases, pressure increases. Without the insert of the present invention, the compressor may begin to stall at lower volumetric air flows, such as at a point 300. A plot 270 represents compressor pressure without an insert of the present invention. At a stall point 280, the tangential slope of the plot 270 becomes negative as volumetric air flow decreases. The tangential slope of the plot 270 becomes positive again if volumetric air flow decreases further. A plot 260, which represents compressor pressure with an insert of the present invention, does not exhibit any stall point, such as the stall point 280 on the plot 270. The region between the point 300 and the stall point 280 represents a stall margin N, which is the range in volumetric air flow of loss in pressure until the compressor stalls (at the stall point 280). As can be seen on the plot 260, the stall margin is not a factor in using the insert of the present invention. Indeed, the tangential slope of a plot 260 does not become negative. Consequently, using the insert of the present invention enables operation over a broad range of volumetric air flow without likelihood of stalling. Referring back to FIG. 5A, a method of remanufacturing a compressor housing 72 may be practiced by replacing and exchanging various inserts 70 within the compressor housing 72. Initially, one may remove a first insert 70 from the bore 48 within the compressor housing 72. Next, one may insert a separate insert 70 (perhaps an insert 70 with a different inner radius F) into the bore 48 to replace the first insert 70. The separate insert 70 may have a longitudinally inwardly spaced annular collar portion 96 and the square edged outlet end 74. The separate insert 70 may be inserted telescopically in the bore 48. The annular collar portion 96 may be nested with a seat 98 on an interior sidewall 98 of the compressor housing 72. Additionally, the annular lip 82 may be spaced longitudinally outwardly from the seat 98. The insert 70 may be secured to the compressor housing 72 in mating cooperation with the seat 98. The insert 70 may be secured with an interference fit.

Although the present invention has been described in considerable detail with reference to certain preferred versions thereof, other versions are possible. Therefore, the spirit and scope of the appended claims should not be limited to the description of the preferred versions contained therein.

We claim:

1. An apparatus for compressing gas, comprising:

a compressor impeller on a shaft;

an impeller inlet tip blade radius; and a replaceable insert;

the shaft and replaceable insert situated within a bore in a compressor housing;

the replaceable insert situated in closely spaced-apart relation to the compressor impeller;

the replaceable insert having a square edged outlet which is smaller in radius than the impeller inlet tip blade radius.

2. The apparatus of claim 1, wherein the replaceable insert is concentrically disposed in relation to the shaft and centrally disposed in relation to the compressor impeller.

3. The apparatus of claim 1, wherein the replaceable insert has a radially outwardly protruding annular lip.

4. The apparatus of claim 1, the replaceable insert length is at least 0.25 times the impeller inlet tip blade radius.

5. The apparatus of claim 1, wherein the replaceable insert is made from a corrosion resistant material.

6. An apparatus for compressing gas, comprising:

a compressor impeller on a shaft; and a replaceable insert concentrically disposed in relation to the shaft and centrally disposed in relation to the compressor impeller; the shaft and replaceable insert within a bore in a compressor housing;

the replaceable insert having a cylindrical shape with a square edged outlet that is smaller in radius than an impeller inlet tip blade radius and the replaceable insert length is at least 0.25 times the impeller inlet tip blade radius.

7. The apparatus of claim 6, wherein the replaceable insert has a constant radius.

8. The apparatus of claim 6, wherein the replaceable insert has an interior radius that is smaller at an outlet end than the interior radius at the inlet end.

9. The apparatus of claim 6, wherein the replaceable insert is made from a corrosion resistant material.

10. The apparatus of claim 6, wherein the replaceable insert is situated in closely spaced-apart relation to the compressor impeller.

11. The apparatus of claim 6, wherein the replaceable insert situated in closely spaced-apart relation to the compressor impeller.

12. The apparatus of claim 6, wherein the replaceable insert has a radially outwardly protruding annular lip;

the radially outwardly protruding annular lip mating with an integrally formed seat within the bore.

13. The apparatus of claim 12, wherein the radially outwardly protruding annular lip mates with an integrally formed seat within the bore within a compressor housing.

14. An apparatus for compressing gas, comprising:

a compressor impeller on a shaft; and an insert concentrically disposed in relation to the shaft and centrally disposed in relation to the compressor impeller; the shaft and insert within a bore in a compressor housing; the insert situated in closely spaced-apart relation to the compressor impeller;

the insert having a cylindrical shape with a square edged outlet and a radially outwardly protruding annular lip.

15. The apparatus of claim 14, wherein the insert is made from a corrosion resistant material.

16. The apparatus of claim 14, wherein the insert is replaceable.

17. The apparatus of claim 14, wherein the insert is secured within the bore by an interference fit.

18. The apparatus of claim 14, wherein the radially outwardly protruding annular lip mates with an integrally formed seat within the bore within the compressor housing.

19. The apparatus of claim 18, wherein the insert is secured within the bore by an interference fit.

20. The apparatus of claim 14, wherein the insert has a constant inner radius.

21. The apparatus of claim 14, wherein the insert has a varying inner radius.

22. The apparatus of claim 14, further comprising an impeller inlet tip blade radius;

wherein the square edged outlet is smaller in radius than the impeller inlet tip blade radius.

23. The apparatus of claim 22, wherein the insert length is at least 0.25 times the impeller inlet tip blade radius.

24. A die cast compressor housing, comprising:

a compressor impeller on a shaft;

a replaceable insert concentrically disposed in relation to the shaft and centrally disposed in relation to the compressor impeller; and the shaft and replaceable insert within a bore in a compressor housing the replaceable insert situated in closely spaced-apart relation to the compressor impeller;

the replaceable insert having a cylindrical shape with a square edged outlet that is smaller in radius than an impeller inlet tip blade radius and the replaceable insert length is at least 0.25 times the impeller inlet tip blade radius;

the replaceable insert made from a corrosion resistant material;

the replaceable insert having an enlarged annular base with a radially outwardly protruding annular lip;

the radially outwardly protruding annular lip mating with an integrally formed seat within the bore;

the replaceable insert secured within the bore by an interference fit.

25. The die cast compressor housing of claim 24, wherein the replaceable inlet insert has constant inner radius.

26. The die cast compressor housing of claim 24, wherein the replaceable inlet insert has varying inner radius.

27. A method of remanufacturing a compressor housing, comprising:

removing a first insert from a bore within a compressor housing;

inserting a separate insert comprising a longitudinally inwardly spaced annular collar portion and a square edged outlet;

positioning the insert telescopically in the bore with the annular collar portion nested with a seat on an interior sidewall of the compressor housing; and securing the insert to the compressor housing in mating cooperation with the seat on an interior sidewall of the compressor housing.

28. The method of claim 27, wherein the separate nozzle insert is made from a corrosion resistant material.

29. The method of claim 27, wherein the separate nozzle insert has a constant inner radius.

30. The method of claim 27, wherein the separate nozzle insert has a varying inner radius.

31. A method of compressing gas, comprising:

introducing a gas into an insert with a square edge outlet;

accelerating centrifugally the gas with an impeller, the impeller having an impeller inlet tip blade radius that is larger than a radius of said square edge outlet; and introducing the gas into a volute fluid conduit;

wherein the volute fluid conduit is in fluid communication with the insert.

* * * * *